US005240111A

United States Patent [19]

Yamashita et al.

[11] Patent Number: 5,240,111

[45] Date of Patent: Aug. 31, 1993

[54] THERMALLY SHRUNK PACKAGE

[75] Inventors: Hideyuki Yamashita, Sakaide; Toyoki Wano, Zentsuuji, both of Japan

[73] Assignee: Okura Industrial Co., Ltd., Japan

[21] Appl. No.: 918,499

[22] Filed: Jul. 24, 1992

[30] Foreign Application Priority Data

Jul. 30, 1991 [JP] Japan ..... 3-067857

[51] Int. Cl.[5] ..... B65D 65/02; B65D 65/28

[52] U.S. Cl. ..... 206/497; 53/442

[58] Field of Search ..... 206/497, 432; 53/442

[56] References Cited

U.S. PATENT DOCUMENTS 2,545,243 3/1951 Rumsey .

5,067,612 11/1991 Tsuchiya et al. ..... 206/497

5,129,518 7/1992 Tanaka et al. ..... 206/497

FOREIGN PATENT DOCUMENTS 2843931 9/1978 Fed. Rep. of Germany .

*Primary Examiner*—William I. Price

*Attorney, Agent, or Firm*—Lorusso & Loud

[57] ABSTRACT

A package in which an article is sealingly enclosed with a thermally shrinkable film having a row perforations used as air discharge port during shrink packaging. A strip of a film is disposed inside of the package to close the perforations and to prevent moisture and germs from entering into the package during storage and transportion of the package.

8 Claims, 3 Drawing Sheets

THERMALLY SHRUNK PACKAGE

This invention relates to a thermally shrunk package and to a method of producing same.

A packaging method in which an article to be packaged is enclosed with a thermally shrinkable film and the resulting enclosure is sealed and heated to package the article by thermal shrinkage of the film is now widely put into practice. Since it is necessary to discharge air from the inside of the sealed enclosure in order to effect the thermal shrinkage of the film, one or more small perforations are generally formed in the film. Such perforations, however, cause problems because air, moisture or germs can enter the package therethrough and because the package is tend to be prematurely torn at the perforated portion.

To cope with this problem, a method is proposed in which such perforations are covered with a label after the shrink packaging. While this method is effective in preventing intrusion of moisture and germs into the package through the perforations, it is difficult and economically disadvantageous to automatically apply the label precisely onto a predetermined portion of the package.

JP-U-63-144,442 discloses a package including an enclosed soft bag and a thermally shrinkable, plastic film enclosing the soft bag and having an air discharge opening, characterized in that the package is obtained by a method including the steps of applying a moisture-proof sheet to the soft bag, enclosing the soft bag with the plastic film so that the air discharge hole is covered with the moisture-proof sheet, and thermally shrinking the plastic film. The application of the moisture-proof sheet onto the soft bag is effected by means of bonding, adhesion or fusion. One problem of the technique described immediately above is that it is necessary to dispose a sheet applying device upstream of an enclosing device in order to perform the entire process in a fully automated mode. The conventional technique has another problem because it is difficult to enclose the soft bag with the film while precisely positioning the air discharging hole in register with the moisture-proof sheet on the bag.

The present invention has been made with the foregoing problems of the conventional shrinkable packaging in view.

In accordance with one aspect of the present invention there is provided a package comprising:

an enclosed article, a first, thermally shrinkable, synthetic resin film enclosing the article and having opposite ends sealed to each other to form a sealed portion, said first film having at least one row of perforations arranged adjacent to and along said sealed portion, and a strip of a second, synthetic resin film interposed between said article and said first film and having a free, one end and the other end connected to said sealed portion, said strip having a width sufficient to cover said perforations.

In another aspect, the present invention provides a method of packaging an article, comprising the steps of:

providing a thermally shrinkable, synthetic resin film having a row of perforations arranged adjacent to and in parallel with one end of said film;

folding said film along a line located between said row of perforations and said one end so that said perforations are entirely covered with the folded portion of said film;

then sealingly enclosing said article with said film such that said folded portion is disposed between said film and said article, thereby to obtain a sealed enclosure in which said perforations are exposed to an outer surface thereof; and then heating said enclosure to cause said film to be shrunk with said perforations serving as outlets of air contained in said enclosure.

The present invention also provides a method of packaging an article, comprising the steps of:

providing a first, thermally shrinkable, synthetic resin film having a row of perforations;

superposing a strip of a second synthetic resin film on said first film to entirely cover said perforations therewith;

then sealingly enclosing said article with said first film such that said strip is disposed between said first film and said article, thereby to obtain a sealed enclosure in which said perforations are exposed to an outer surface thereof; and then heating said enclosure to cause said first film to be shrunk with said perforations serving as outlets of air contained in said enclosure.

The present invention will be described in detail below with reference to the accompanying drawings, in which.

Figure 1:
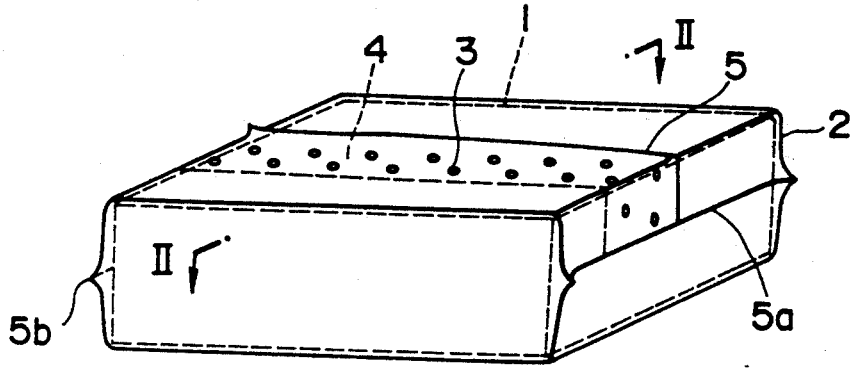
FIG. 1 is a perspective view diagrammatically showing a package according to one embodiment of the present invention.
Figure 2:
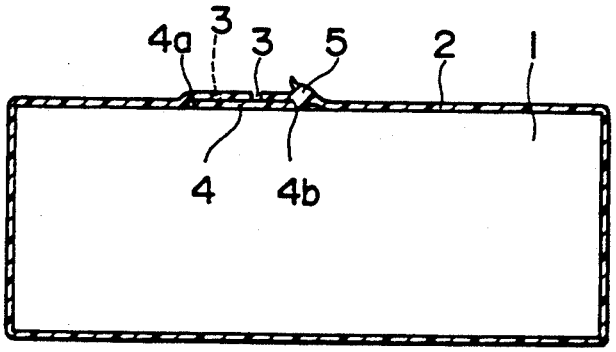
FIG. 2 is a cross-sectional view taken on line II—II in FIG. 1.

Referring first to FIGS. 1 and 2, designated as 1 is an article enclosed with a first, thermally shrinkable, synthetic resin film 2. Any known thermally shrinkable film may be used for the purpose of the present invention. Illustrative of suitable thermally shrinkable films are single layer films of polypropylene, polyethylene or poly(vinyl chloride) and composite films having a layer of the above resin. Gas-barrier films such as single layer films of nylon, polyethylene terephthalate, an ethylene-vinyl alcohol copolymer or poly(vinylidene chloride) and composite films having a layer of the above resin may also be suitably used.

Designated as 5 is a sealed portion at which opposite ends of the first film 2 are sealed to each other. The first film 2 is also sealed at portions 5*a* and 5*b*. Arranged adjacent to and along the sealed portion 5 are one to three rows (two rows in the illustrated case) of perforations 3.

A strip 4 of a second, synthetic resin film is interposed between the article 1 and the first film 2. The strip 4 has a free, one end 4*a* and the other, base end 4*b* connected to the sealed portion 5 and is wide enough to to cover the two rows of perforations 3. Generally, the strip 4 has a width of 2–10 cm.

The above package may be prepared as follows.

Figure 3:
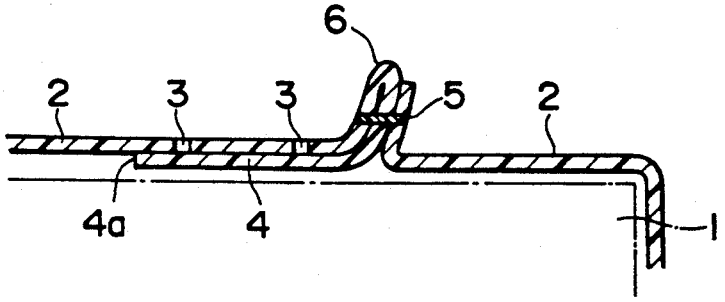
FIG. 3 is an enlarged, sectional view showing an example of the fabrication of the sealed portion of FIG. 1.

As shown in FIG. 3, a thermally shrinkable, synthetic resin film 2 having one to three rows of perforations 3 arranged adjacent to and in parallel with one end 4*a* of the film 2 is folded along a line 6 located between the of perforations 3 and the one end 4*a* such that the perforations 3 are entirely covered with the folded portion 4 of the film 2.

Then an article 1 is sealingly enclosed with the film 2 such that the folded portion 4 is disposed between the film 2 and the article 1, thereby to obtain a sealed enclosure in which the perforations 3 are exposed to an outer surface thereof. The sealing is performed by means of an electric sealer. Thus, opposite edges of the film 2 are gathered, pinched and heated with the sealer at a portion 5 so that the tip portions of the film 2 are fused in the portion 5 and cut along the portion 5. Thereafter, openings are sealed by means of the sealer to form sealed portions 5*a* and 5*b*, whereby an enclosure is obtained.

Figure 4:
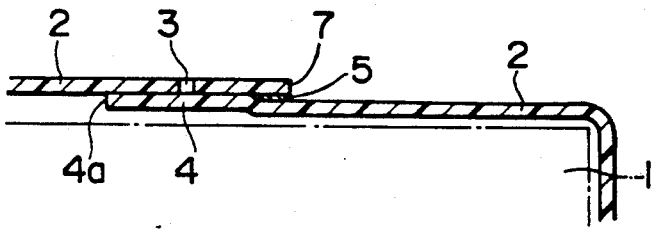
FIG. 4 is an enlarged, sectional view showing another example of the fabrication of the sealed portion of FIG. 1.

In an alternate, as shown in FIG. 4, an article 1 is enclosed with a thermally shrinkable film 2 having perforations 3 adjacent to and along first end 7 thereof. In this case, portions of the film 2 adjacent both of the first and second ends 7 and 4*a* thereof are overlapped such that the portion 4 adjacent the second end 4*a* is located between the article 1 and the portion adjacent the first end 7 and that the perforations 3 are covered with the portion 4. The overlapped portion is sealed in the first end portion 7 to form a sealed portion 5. The seal may be effected by a suitable adhesive. Thereafter, openings are sealed by means of the sealer to form sealed portions 5*a* and 5*b*, whereby an enclosure is obtained.

The enclosure thus obtained by the foregoing methods is heated in an oven to cause the film 2 to be shrunk with the perforations 3 serving as outlets of air contained in the enclosure. Namely, when the enclosure is introduced into the oven, air within the enclosure is expanded to inflate the film 2. This causes formation of a space between that portion of the upper film having the perforations 3 and that portion 4 of the lower film covering the perforations 3. As a result, as the film 2 is shrunk, the air within the enclosure is discharged therefrom through the perforations 3. When the shrinkage is completed, the perforations 3 are tightly closed with the portion 4 of the lower film.

Figure 5:
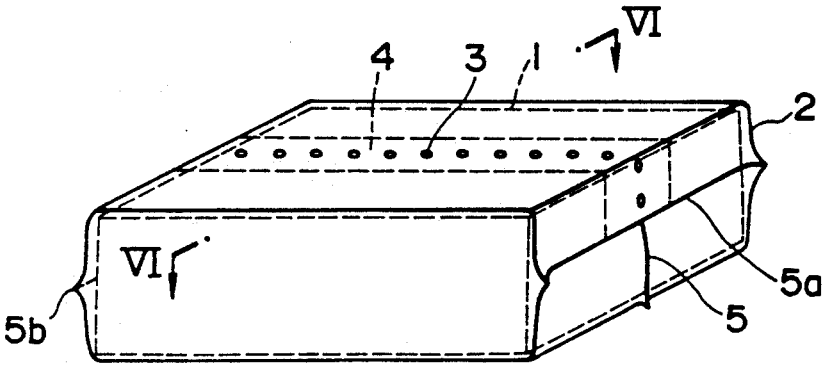
FIG. 5 is a perspective view, similar to FIG. 1, showing a package according to another embodiment of the present invention.
Figure 6:
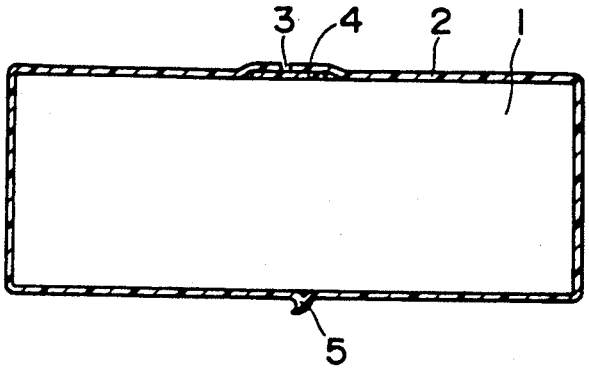
FIG. 6 is a cross-sectional view taken on line VI—VI in FIG. 5.

FIGS. 5 and 6 illustrate another embodiment of the package. In this embodiment, an article 1 is enclosed by a first, thermally shrinkable, synthetic resin film 2 having a row of perforations 3. Interposed between the article 1 and the first film 2 is a strip 4 of a second, thermally shrinkable, synthetic resin film. The strip 4 which has a width of generally 2–10 cm is located to cover the row of perforations 3. The first and second films 2 and 4 may be formed of the same or different resin. However, it is preferred that the strip 4 of the second film have a shrinkability similar to that of the film 2, since the finish of the package is beautiful.

The package of this second embodiment may be prepared as follows.

Figure 7:
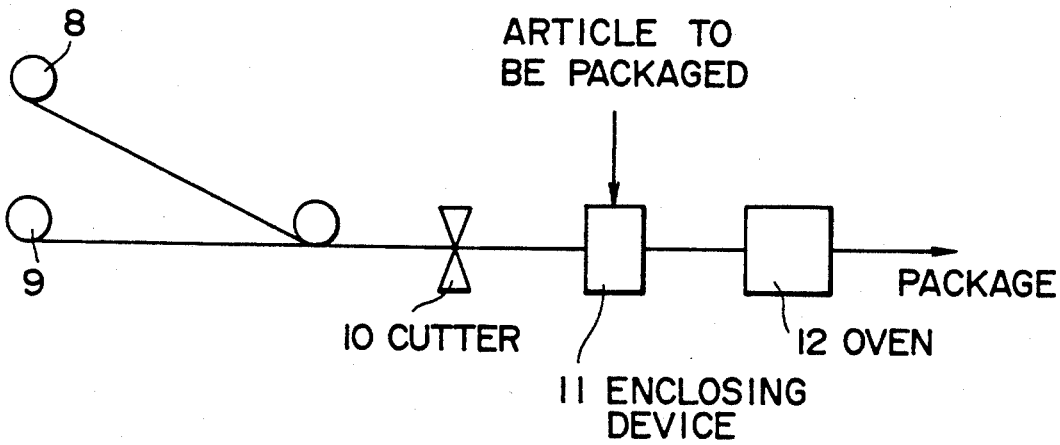
FIG. 7 is a flow chart schematically showing an apparatus for carrying out packaging method according to the present invention.

At first, a first, thermally shrinkable, synthetic resin film 2 having a row of perforations 3 is overlaid with a strip 4 of a second synthetic resin film so that the perforations 3 are covered with the strip 4. This can be performed by, as shown in FIG. 7, feeding the strip 4 unwound from a roll 8 to a transfer path of the film 2 unwound from a roll 9 and severing the both films to a predetermined length in a cutting station 10.

An article is enclosed by the first film 2 in an enclosing station 11 such that the strip 4 is disposed between the first film 2 and the article 1. Fuse-bonding is performed to seal the film 2 thereby to obtain a sealed enclosure which has sealing portions 5 (FIG. 6) and 5*a* and 5*b* (FIG. 5) and in which the perforations 3 are exposed to an outer surface thereof. The thus obtained enclosure is introduced into an oven 12 to heat the film 2 so that the film 2 is shrunk with the perforations 3 serving as outlets of air contained in the enclosure.

In the foregoing embodiments, various modifications may be made. For example, it is desirable to apply a hot melt adhesive over the surface of the portion 4 which is in contact with the top film having the perforations 3. The adhesive is melted in the thermal shrinking stage of the film 2 to permit the separation of the portion 4 from the top film but, after the completion of the shrinkage, functions as an adhesive so that the perforations 3 are completely sealed. The use of a film, as the strip 4, which has a tendency of causing blocking when contacted with the film 2 is also preferable to obtain improved sealing therebetween. The number of the row of perforations 3, the number of the perforations 3 in each row and the size of each perforation 3 may be suitably determined in view of required air discharging rate. By forming a row of the perforations 3 with an only small space therebetween, the row of perforations 3 can be used for tearing the package therealong.

What is claimed is:

1. A package comprising:

an enclosed article, a first, thermally shrinkable, synthetic resin film enclosing the article and having opposite ends sealed to each other to form a sealed portion, said first film having at least one row of perforations arranged adjacent to and along said sealed portion, and a strip of a second, synthetic resin film interposed between said article and said first film and having a free, one end and the other end connected to said sealed portion, said strip having a width sufficient to cover said perforations.

2. A package as claimed in claim 1, wherein said first and second films are made of the same material.

3. A package as claimed in claim 1, wherein said opposite ends of said first film and said the other end of said second film are bonded together by fuse bonding.

4. A package as claimed in claim 1, wherein said opposite ends of said first film are sealed to each other by an adhesive.

5. A package as claimed in claim 1, wherein said strip has a width of 2–10 cm.

6. A method of packaging an article, comprising the steps of:

providing a thermally shrinkable, synthetic resin film having a row of perforations arranged adjacent to and in parallel with one end of said film;

folding said film along a line located between said row of perforations and said one end so that said perforations are entirely covered with the folded portion of said film;

then sealingly enclosing said article with said film such that said folded portion is disposed between said film and said article, thereby to obtain a sealed enclosure in which said perforations are exposed to an outer surface thereof; and then heating said enclosure to cause said film to be shrunk with said perforations serving as outlets of air contained in said enclosure.

7. A method of packaging an article, comprising the steps of:

providing a first, thermally shrinkable, synthetic resin film having a row of perforations;

superposing a strip of a second synthetic resin film on said first film to entirely cover said perforations therewith;

then sealingly enclosing said article with said first film such that said strip is disposed between said first film and said article, thereby to obtain a sealed enclosure in which said perforations are exposed to an outer surface thereof; and then heating said enclosure to cause said first film to be shrunk with said perforations serving as outlets of air contained in said enclosure.

8. A method as claimed in claim 7, wherein said second film is thermally shrinkable.

* * * * *